US005187828A

United States Patent [19]

Hoffmann et al.

[11] Patent Number: 5,187,828

[45] Date of Patent: Feb. 23, 1993

[54] TRACTOR POWER BROOM APPARATUS

[76] Inventors: Gerald W. Hoffmann, W939 CTY-FF; John Van der Male, 3746 Koehler Dr., both of Sheboygan, Wis. 53083

[21] Appl. No.: 905,449

[22] Filed: Jun. 29, 1992

[51] Int. Cl.[5] ..... E01H 1/05

[52] U.S. Cl. ..... 15/82; 15/52.1

[58] Field of Search ..... 15/50.3, 52.1, 55, 79.2, 15/82, 83, 340.3, 340.4

[56] References Cited

U.S. PATENT DOCUMENTS 2,330,025 9/1943 Bentley et al. ..... 15/82

2,548,676 4/1951 Milz et al. ..... 15/82

3,114,923 12/1963 Jones ..... 15/82

3,624,853 12/1971 Kromer ..... 15/82

*Primary Examiner*—Edward L. Roberts

*Attorney, Agent, or Firm*—Leon Gilden

[57] ABSTRACT

A self-propelled tractor is operative through a gear drive to effect rotation of a cylindrical broom member mounted forwardly of the associated tractor. The broom member is selectively rotatable through a linkage assembly mounted to the broom and to the tractor. Rotation of the broom effects sweeping of debris and leaves relative to a lawn. Cleaning rods are directed into the broom and reciprocatable relative to the broom to effect cleaning of the bristles during use.

3 Claims, 4 Drawing Sheets

TRACTOR POWER BROOM APPARATUS

BACKGROUND OF THE INVENTION

1. Field of the Invention

The field of invention relates to garden apparatus, and more particularly pertains to a new and improved tractor power broom apparatus wherein the same is arranged to provide for a self-propelled broom member to effect sweeping of a lawn.

2. Description of the Prior Art

Brush assemblies of various types are utilized in the prior art and self-propelled power brooms or brush structure is exemplified in U.S. Pat. No. 4,393,537 to ReProgle, et al. wherein a power broom is operative in association with a vacuum.

U.S. Pat. No. 4,197,607 to Whitson sets forth a sweeper for cleaning floors, wherein the sweeper includes a plurality of brushes in combination with cutting knives disposed adjacent the brushes.

U.S. Pat. No. 4,120,311 to Dunham sets forth a vacuum operated debris removal structure arranged to collect debris swept by power broom structure.

U.S. Pat. No. 3,491,395 to McCandless sets forth a further example of a power broom structure utilized in the prior art.

The prior art has heretofore failed to address the compact and operative association of the components as set forth by the instant invention permitting the retrofit of the structure to an existing tractor structure and in this respect, the present invention sets forth a new and improved tractor broom apparatus addressing both the problems of ease of use as well as effectiveness in construction.

SUMMARY OF THE INVENTION

In view of the foregoing disadvantages inherent in the known types of power broom structure now present in the prior art, the present invention provides a tractor power broom apparatus wherein the same is addressed to the operative mounting of a rotary cylindric al broom forwardly of an associated tractor. As such, the general purpose of the present invention, which will be described subsequently in greater detail, is to provide a new and improved tractor power broom apparatus which has all the advantages of the prior art power broom apparatus and none of the disadvantages.

To attain this, the present invention provides a self-propelled tractor operative through a gear drive to effect rotation of a cylindrical broom member mounted forwardly of the associated tractor. The broom member is selectively rotatable through a linkage assembly mounted to the broom and to the tractor. Rotation of the broom effects sweeping of debris and leaves relative to a lawn. Cleaning rods are directed into the broom and reciprocatable relative to the broom to effect cleaning of the bristles during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tractor power broom apparatus which has all the advantages of the prior art power broom apparatus and none of the disadvantages.

It is another object of the present invention to provide a new and improved tractor power broom apparatus which may be easily and efficiently manufactured and marketed.

It is a further object of the present invention to provide a new and improved tractor power broom apparatus which is of a durable and reliable construction.

An even further object of the present invention is to provide a new and improved tractor power broom apparatus which is susceptible of a low cost of manufacture with regard to both materials and labor, and which accordingly is then susceptible of low prices of sale to the consuming public, thereby making such tractor power broom apparatus economically available to the buying public.

Still yet another object of the present invention is to provide a new and improved tractor power broom apparatus which provides in the apparatuses and methods of the prior art some of the advantages thereof, while simultaneously overcoming some of the disadvantages normally associated therewith.

These together With other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
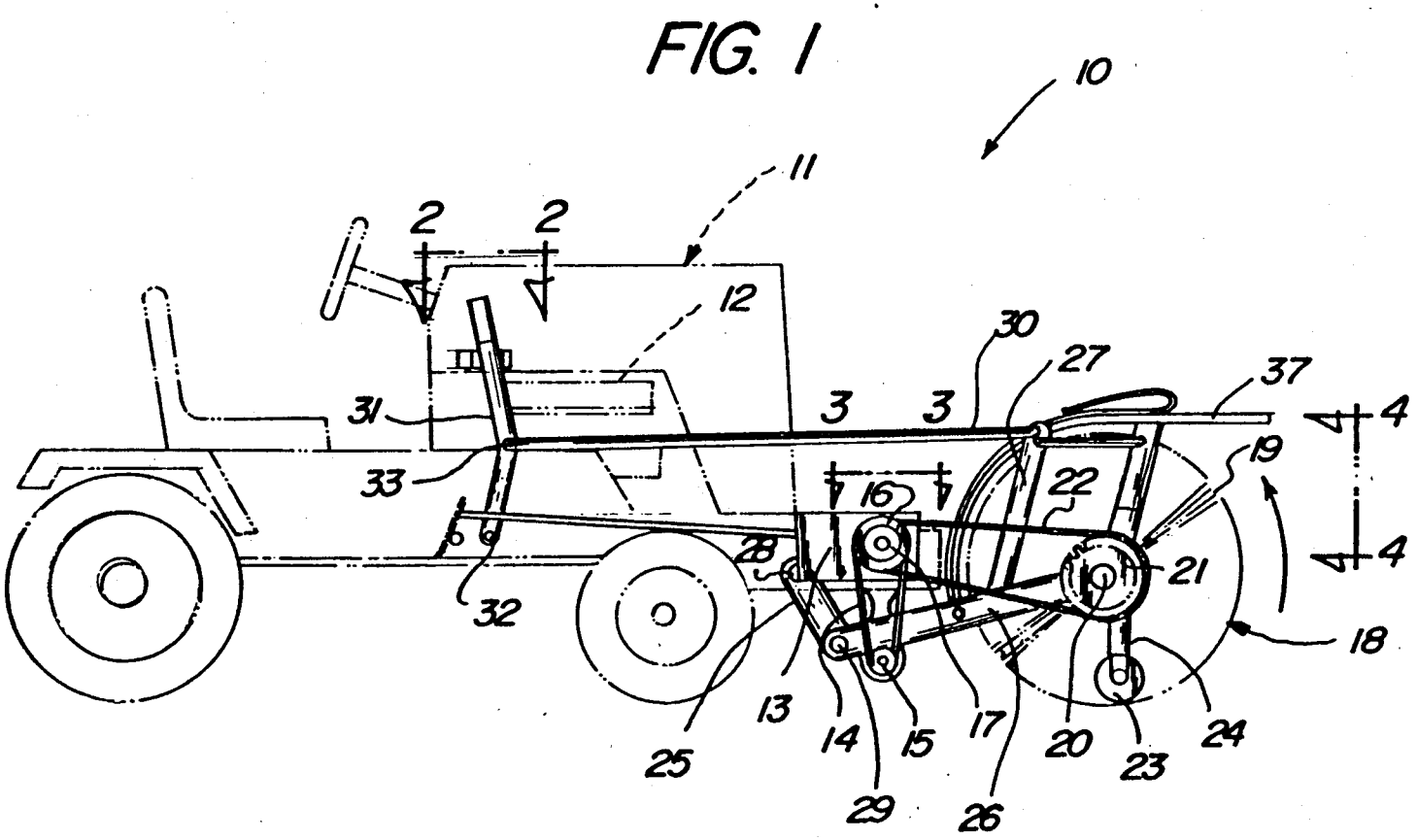
FIG. 1 is an orthographic side view of the instant invention.
Figure 2:
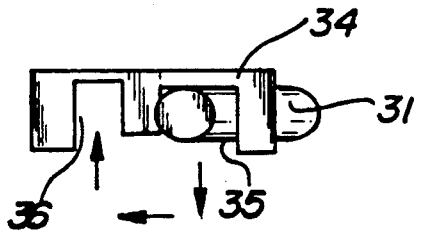
FIG. 2 is an orthographic view, taken along the lines 2—2 of FIG. 1 in the direction indicated by the arrows.
Figure 3:
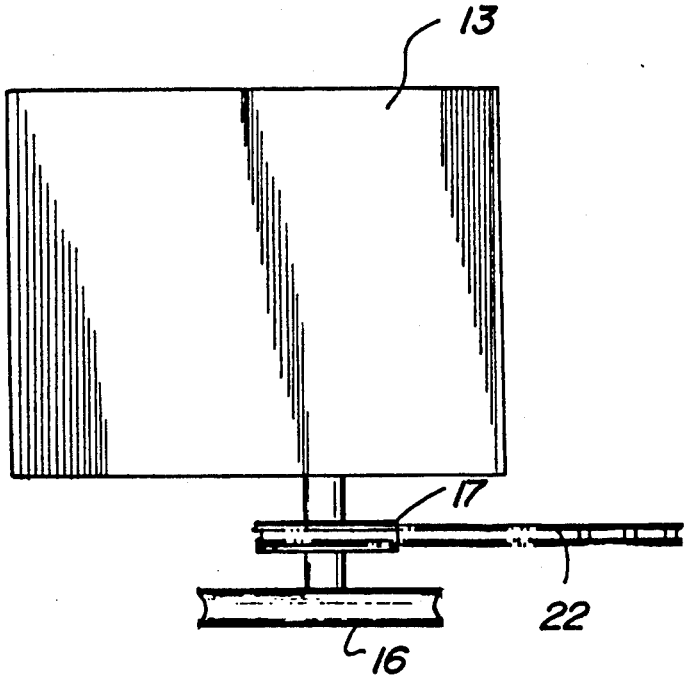
FIG. 3 is an orthographic view, taken along the lines 3—3 of FIG. 1 in the direction indicated by the arrows.
Figure 4:
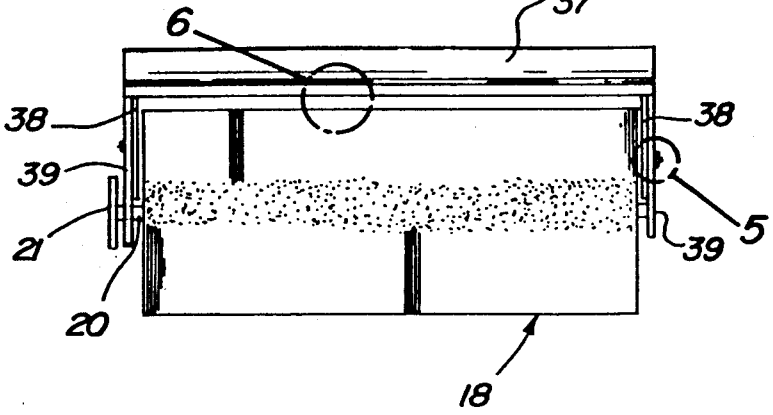
FIG. 4 is an orthographic view, taken along the lines 4—4 of FIG. 1 in the direction indicated by the arrows.
Figure 5:
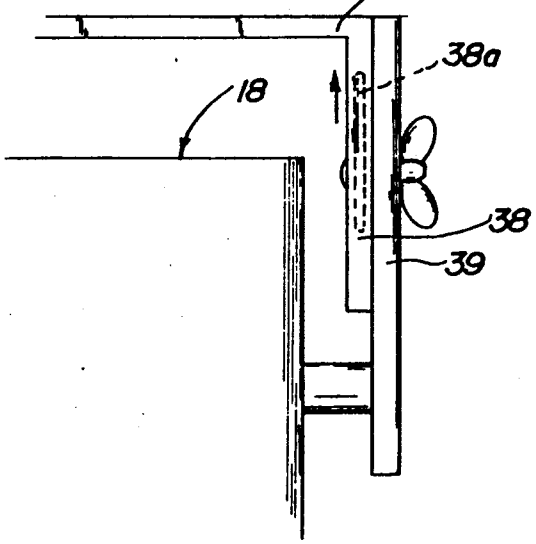
FIG. 5 is an orthographic enlarged view of section 5 set forth in FIG. 4.
Figure 7:
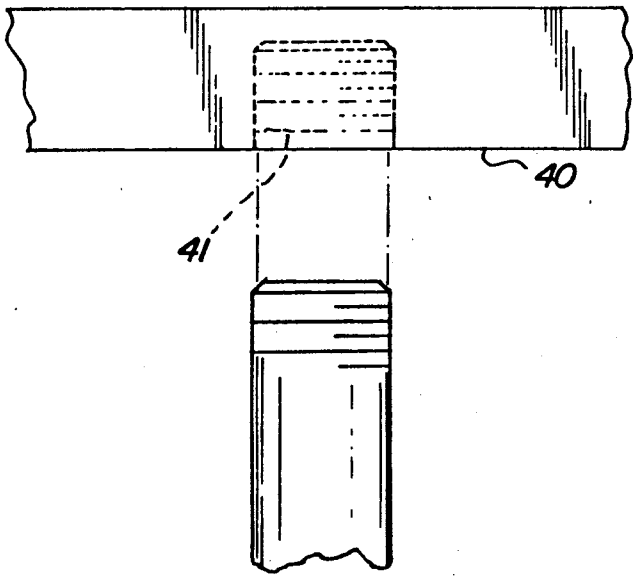
FIG. 7 is an enlarged orthographic view of section 7 set forth in FIG. 6 illustrating a cleaning rod separated relative to an associated mounting bore.
Figure 6:
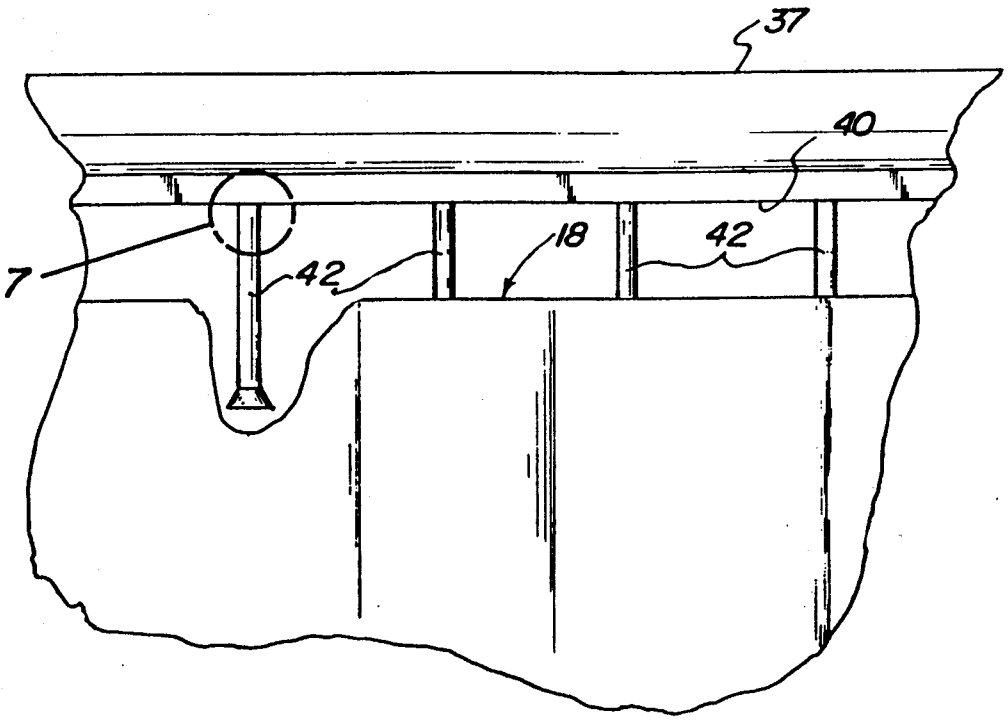
FIG. 6 is an orthographic enlarged view of section 6 set forth in FIG. 4.

With reference now to the drawings, and in particular to FIGS. 1 to 7 thereof, a new and improved tractor power broom apparatus embodying the principles and concepts of the present invention and generally designated by the reference numeral 10 will be described.

More specifically, the tractor power broom apparatus 10 of the instant invention essentially comprises the use of a tractor member 11 of a self-propelled configuration having a drive motor 12 in operative communication with the transmission housing 13 mounted forwardly of the tractor assembly. A transmission drive belt 14 is operative through a tractor drive pulley 15 and a transmission drive pulley 16 to effect rotation of a transmission output sprocket 17. The tractor drive pulley 15 may be operative through the tractor assembly and the tractor drive motor 12 in a manner convenient to one of ordinary skill in the art utilizing the power take-off assemblies and the like.

A broom member 18 of a cylindrical configuration is mounted rotatably forwardly of the tractor 11. The cylindrical broom member 18 includes a matrix of radially oriented bristles 19 mounted to a broom central axle 20, with the broom central axle 20 orthogonally oriented relative to the side walls of the tractor and oriented forwardly thereof. The broom central axle 20 includes a central axle sprocket 21, including a drive chain 22 associating the central axle sprocket 21 with the transmission output sprocket 17 to effect rotation of the broom member 18. A broom support wheel 23 mounted to a support wheel shaft 24, which in turn is secured to a forward end of a second link member 26 of the link assembly, positions the broom member 18 relative to an underlying lawn. The broom assembly includes a first link member 25 having a first link member rear end portion pivotal about a first pivot axle 28, with a first link member forward end including a second pivot axle 29 pivotally mounting the first link member 25 to a rear distal end of the second link member 26. The forward end of the second link member 26 mounted to the broom central axle 20, as noted above, supports the support wheel shaft 24 and the associated support wheel 23. A third link member 27 is fixedly mounted to the second link member between the second pivot axle 29 and the forward distal end of the second link member 26. An upper distal end of the third link member 27 includes a forward end of a fourth link 30 pivotally secured thereto, wherein the fourth link 30 extends rearwardly of the broom member 18 substantially orthogonally oriented relative to the broom central axle 20 and is pivotally mounted substantially medially of a fifth link 31. A lower end of the fifth link 31 is mounted about a fifth link lower pivot axle 32, with the fifth link 31 received within a positioning bracket 34, and more specifically within respective first and second recesses 35 and 36 of the positioning bracket 34. The fourth link 30 pivotally mounted to the fifth link 31 is pivotally secured thereto about a pivot junction 33. Accordingly, when the fifth link 31 is in the first recess 35, tension to the broom drive chain 32 is heightened for operative directing of torque from the transmission housing 13. Rearward deflection of the fifth link 31 within the second recess 36 affords lessening of tension engagement of the output sprocket 17 to the central axle sprocket 21. The drive chain 22 may be configured in a drive belt in operative communication between an output pulley 16 and a central axle pulley 21 to effect rotative disengagement of the broom member 18.

The broom member 18 includes a cover hood 37 having cover hood support legs 38 including slots 38*a* operative through fasteners to central axle support legs 39 mounted to the central axle, wherein raising and lowering of the cover hood 37 is effected. The cover hood includes a cover hood bottom wall 40 having a plurality of threaded mounting bores 41 directed therealong to receive spring steel brush cleaning rods 42 therewithin. In this manner, raising and lowering of the brush rods relative to the bristles 19 is arranged to effect selective cleaning of the cylindrical broom member 18 during use.

U.S. Pat. No. 3,491,395 to McCandless sets forth a pulley and drive belt assembly arranged for operative driving of a brush member whose teaching is incorporated herein by reference.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention..

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tractor power broom apparatus, comprising, a tractor, the tractor including a tractor drive motor, and a transmission drive housing in operative communication with a drive motor, and the transmission housing including an output pulley, and the tractor member having spaced side walls, with a broom central axle, and the broom central axle positioned forwardly of the tractor member orthogonally oriented relative to the parallel sides, and the broom central axle including a cylindrical broom mounted fixedly thereabout, wherein the cylindrical broom includes a matrix of radially oriented bristles directed into the broom central axle, with the broom central axle including a central axle pulley, with the transmission output pulley in operative communication with the central axle pulley, and first link member having a first link member first end pivotally mounted about a first pivot axle to the tractor member, the first link member including a first link member second end, and a second link member, the second link member including a second link member first end pivotally mounted to the first link member about a second pivot axle, and the second link member projecting forwardly of the first link member having a second link member forward end mounted to the broom central axle, and third link member fixedly mounted to the second link member, with the third link member including a third link member upper distal end spaced from the second link member, and a fourth link member, with the fourth link member forward end pivotally mounted to the third link member upper distal end, and a fifth link member pivotally mounted to the tractor at a fifth link member lower distal end, and the fourth link member including a pivot junction, and the fourth link member including a fourth link member rear distal end pivotally mounted to the fifth link member at the pivot junction, and a positioning bracket mounted to the tractor assembly, with the positioning bracket including a first recess spaced from a second recess, and drive means in operative communication between the transmission output pulley and the central axle pulley, wherein positioning of the fifth member within the first recess effects tensioning of the drive belt and positioning of the fifth link member within the second recess effects slackening of the drive belt.

2. An apparatus as set forth in claim 1 wherein the broom central axle includes central axle support legs orthogonally mounted to opposed ends of the central axle, and a cover hood, the cover hood including cover hood slotted support legs adjustably mounted vertically relative to the central axle support legs to effect vertical adjustment of the cover hood relative to the central axle.

3. An apparatus as set forth in claim 2 wherein the cover hood includes a cover hood bottom wall, the cover hood bottom wall including a matrix of threaded mounting bores, and each mounting bore of said matrix of threaded mounting bores includes a spring steel brush cleaning rod orthogonally directed and oriented relative to the cover hood bottom wall projecting into the broom member to effect cleaning of the broom member during use.

* * * * *